US010823043B2

(12) United States Patent
Bartalini et al.

(10) Patent No.: US 10,823,043 B2
(45) Date of Patent: Nov. 3, 2020

(54) OUTER PIPE OF AN OUTLET OF A VOLUTE OF A HEAT-TRANSFER PUMP OF A HEAT ENGINE OF A VEHICLE

(71) Applicant: NISSAN MOTOR CO., LTD., Yokohama (JP)

(72) Inventors: Michel Bartalini, Vieille Eglise en Yvelines (FR); Xavier Decomble, Verneuil-sur-Seine (FR)

(73) Assignee: NISSAN MOTOR CO., LTD., Yokohama (JP)

( * ) Notice: Subject to any disclaimer, the term of this patent is extended or adjusted under 35 U.S.C. 154(b) by 49 days.

(21) Appl. No.: 16/323,886

(22) PCT Filed: Aug. 3, 2017

(86) PCT No.: PCT/FR2017/052178
§ 371 (c)(1),
(2) Date: Feb. 7, 2019

(87) PCT Pub. No.: WO2018/033669
PCT Pub. Date: Feb. 22, 2018

(65) Prior Publication Data

US 2020/0191040 A1 Jun. 18, 2020

(30) Foreign Application Priority Data

Aug. 16, 2016 (FR) ..... 16 57775

(51) Int. Cl.
*F01P 5/10* (2006.01)
*F01P 11/04* (2006.01)
(Continued)

(52) U.S. Cl.
CPC ..... *F01P 5/10* (2013.01); *F01P 3/20* (2013.01); *F02F 1/26* (2013.01); *F02F 1/40* (2013.01);
(Continued)

(58) Field of Classification Search
CPC ..... F01P 5/10; F01P 3/20; F01P 3/02; F01P 11/04; F01P 2003/027; F01P 2007/146;
(Continued)

(56) References Cited

U.S. PATENT DOCUMENTS 1,754,689 A 4/1930 MacPherson
4,777,912 A * 10/1988 Fischer ..... F01P 5/10 123/41.79
(Continued)

FOREIGN PATENT DOCUMENTS

EP 0 637 681 A1 2/1995
EP 0999 353 A1 5/2000
(Continued)

*Primary Examiner* — Jacob M Amick
(74) *Attorney, Agent, or Firm* — Foiey & Lardner LLP

(57) ABSTRACT

The invention relates to an outer pipe (1) of an outlet (4) of a volute (3) of a heat transfer pump (2), particularly arranged in a recess defined in a heat engine of a vehicle, the outer pipe (1) being provided on an outer surface (9) of the cylinder housing (8) of the engine and comprising a first component (5*a*) capable of guiding the heat-transfer fluid from said outlet (4) to an inlet (6) of an inner circuit (7) for circulating the heat-transfer fluid defined in the cylinder housing (8).

8 Claims, 3 Drawing Sheets

Figure 1:
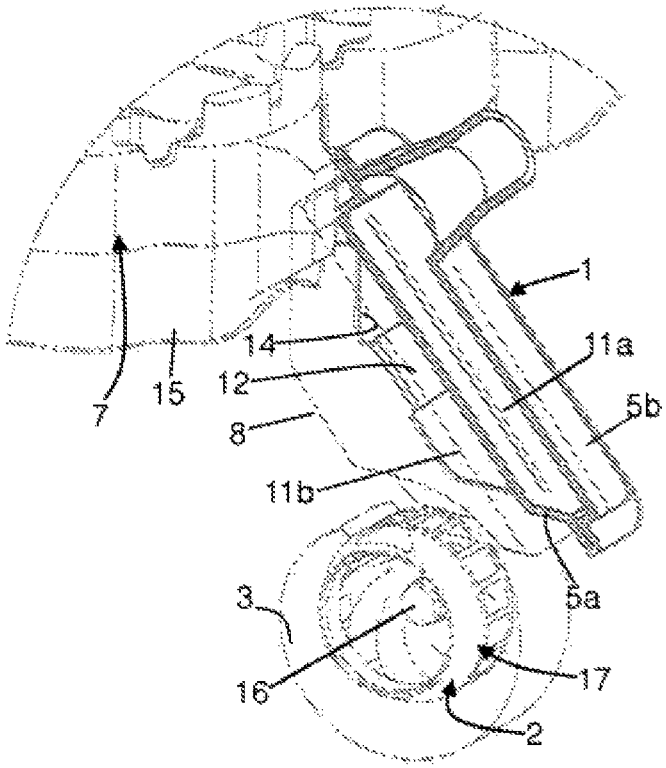

(51) Int. Cl.

| | |
|---|---|
| ***F01P 3/20*** | (2006.01) |
| ***F02F 1/40*** | (2006.01) |
| ***F02F 1/26*** | (2006.01) |
| *F01P 3/02* | (2006.01) |
| *F01P 7/14* | (2006.01) |
| *F02F 1/14* | (2006.01) |
| *F01P 5/06* | (2006.01) |

(52) U.S. Cl.
CPC . *F01P 3/02* (2013.01); *F01P 5/06* (2013.01); *F01P 11/04* (2013.01); *F01P 2003/027* (2013.01); *F01P 2007/143* (2013.01); *F01P 2007/146* (2013.01); *F01P 2060/04* (2013.01); *F01P 2060/08* (2013.01); *F01P 2060/16* (2013.01); *F02F 1/14* (2013.01)

(58) Field of Classification Search
CPC ..... F01P 2060/04; F01P 2060/08; F01P 2060/16; F01P 2007/143; F01P 5/06; F02F 1/14; F02F 1/40; F02F 1/10; F02F 1/26; F02F 1/36
See application file for complete search history.

(56) References Cited

U.S. PATENT DOCUMENTS

| | | | | |
|---|---|---|---|---|
| 5,503,117 | A | 4/1996 | Saito | |
| 2002/0100434 | A1 | 8/2002 | Kawamoto et al. | |
| 2012/0240880 | A1 * | 9/2012 | Hineiti ..... | F01M 11/02 123/41.33 |

FOREIGN PATENT DOCUMENTS

| | | | |
|---|---|---|---|
| GB | 1 279 132 | A | 6/1972 |
| JP | 07-127477 | A | 5/1995 |

* cited by examiner

OUTER PIPE OF AN OUTLET OF A VOLUTE OF A HEAT-TRANSFER PUMP OF A HEAT ENGINE OF A VEHICLE

The present invention relates to an outer pipe of an outlet of a volute of a heat-transfer fluid pump of a heat engine of a vehicle.

The invention also relates to a cylinder housing including such an outer pipe as well as to an engine including said cylinder housing.

The invention also relates to a vehicle, in particular a motor vehicle, comprising such an engine.

In the prior art, a heat engine typically comprises a cylinder housing sealed by a cylinder head. For the proper operation of the engine, said housings must be cooled. To that end, the engine includes a cooling circuit in which a heat-transfer fluid is circulated using a pump and which, in turn, is cooled by extending through a radiator. Such a pump traditionally comprises a volute, an outlet of which is connected by a pipe to an inner circuit of the cylinder housing, comprising cooling chambers enabling the circulation of said fluid around the cylinders of the engine.

One general problem with such an engine is related to the fact that the pump and part of the cooling circuit, including the pipe connecting the outlet of the volute to the inner circuit of the cylinder housing, are traditionally arranged at an outer surface of the engine and thus are so bulky so as to not be suitable for the size of the engine compartment of modern vehicles.

Indeed, automobile builders and/or drivers are currently seeking, in light of the size of such compartments, to produce increasingly compact engines that nevertheless have improved performance in terms of power and/or output, which often involves an increase in thermal loads in terms of the latter.

With a view to reducing said bulk, a solution is known from the prior art that involves the integration of the pump in the cylinder housing of the engine as well as the pipe connecting the outlet of the volute of said pump to the inner circuit of the cylinder housing.

However, such a solution can only be implemented in a limited number of cylinder housings, since the production thereof intrinsically depends on the foundry method used to manufacture said cylinder housing.

The present invention aims to overcome these drawbacks related to the prior art.

To that end, the invention relates to an outer pipe of an outlet of a volute of a heat-transfer fluid pump in particular arranged in a recess defined in a heat engine of a vehicle, the outer pipe being included on an outer surface of a cylinder housing of the engine and comprising a first component capable of guiding the heat-transfer fluid from said outlet toward an inlet of an inner circuit for circulating the heat-transfer fluid defined in the cylinder housing.

In other embodiments:

- the outer pipe includes a second component forming, together with the first component, a first channel for circulating the heat-transfer fluid toward at least one device of the cooling circuit;
- the first component forms, together with the outer surface of the housing, a second channel for circulating the heat-transfer fluid toward said inlet of the inner circuit for circulating the heat-transfer fluid defined in the cylinder housing;
- the first component includes an area through which the heat-transfer fluid passes from the second channel to a first channel;

- an area through which the heat-transfer fluid passes from the second channel to a first channel including at least one opening;
- the first component and a second component are two separate parts that are sealingly connected to one another;
- the first component and a second component together form a single part, and
- the outer pipe is a removable part and/or an attachment.

The invention also relates to a cylinder housing of an engine of a vehicle including a cooling circuit provided with a heat-transfer pump arranged in said cylinder housing and such an outer pipe.

In other embodiments:

- the outer surface of said housing includes a cavity for mounting said outer pipe;
- the cylinder housing is manufactured according to a high-pressure casting foundry process;
- the cylinder housing is made from aluminum or an aluminum alloy;
- the mounting cavity forms a cavity, in particular provided with two ports corresponding to the outlet of the volute of the heat-transfer fluid pump and to the inlet of the inner circuit for circulating the heat-transfer fluid defined in the cylinder housing, respectively, and
- the mounting cavity includes a connection area where the outer pipe is mechanically and sealingly connected to the outer surface of the cylinder housing.

The invention also relates to an engine including such a cylinder housing.

The invention also relates to a vehicle, in particular a motor vehicle, including such an engine.

Figure 2:
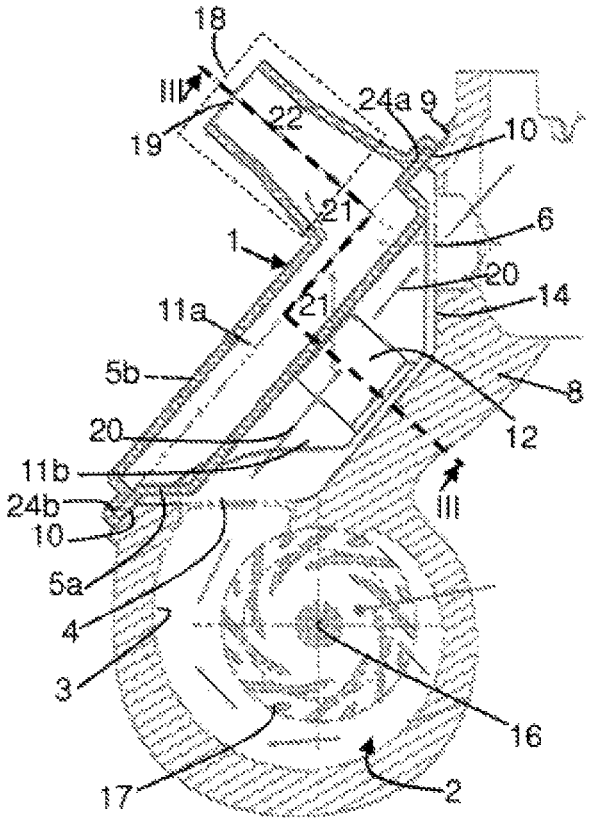
Figure 3:
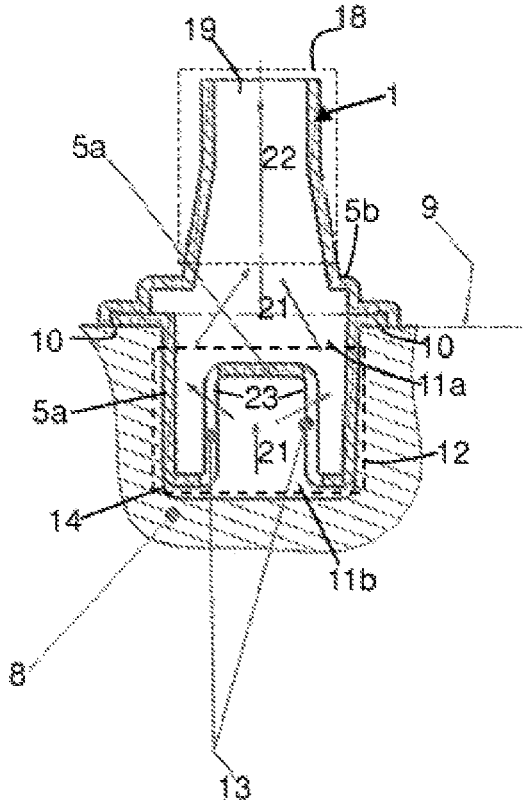

Other advantages and features of the invention will be better manifested upon reading the description of one preferred embodiment that follows, in reference to the figures, provided as an indicative and non-limiting example:

FIG. 1 shows a perspective sectional view of part of the cylinder housing including a heat-transfer pump and an outer pipe according to the embodiment of the invention;

FIG. 2 shows a sectional view of part of the cylinder housing including the heat-transfer fluid pump and the outer pipe according to the embodiment of the invention, and FIG. 3 shows a cross-sectional view along line III-III of part of the outer pipe arranged on an outer surface of the cylinder housing including an area for the passage of the heat-transfer fluid according to the embodiment of the invention.

In the following description, identical reference figures denote identical parts or parts having similar functions.

FIGS. 1 to 3 show part of a cylinder housing 8 of a heat engine of a vehicle, in particular a motor vehicle, traditionally comprising said cylinder housing 8, commonly referred to as a "cylinder block", at the top of which a cylinder head is arranged. Such a cylinder housing 8 may, for weight reduction purposes, be manufactured from aluminum, and may, for cost-efficiency and mass-production purposes, be produced using a high-pressure casting foundry process.

As is known, said cylinder housing 8 comprises an inner circuit 7 for circulating a heat-transfer fluid, also referred to as "coolant," e.g. for cooling the engine while circulating said fluid around the cylinders of the engine. The inner circuit 7 comprises an inner supply pipe 15 consisting of at least one cooling chamber, the inlet 6 which includes an inlet port, and which leads to a cavity 14 for mounting said cylinder housing 8.

Said mounting cavity 14 also includes an outlet 4 provided with a port of a volute 3 of a heat-transfer pump 2 for circulating said pressurized fluid in a cooling circuit of said engine. Said outlet 4 is a port 4 in communication with the cavity of the volute 3 of the pump 2. Such a pump 2 is preferably arranged in a recess defined in the engine and in particular in a recess defined in the cylinder housing 8, so as to reduce the size of the engine. The volute 3, also referred to as a "high-pressure chamber", of the pump 2 is intended to receive a blade 17, or a turbine, contributing to the circulation of the pressurized fluid in the cooling circuit. Said blade 17 is mounted on one end 16 of a pump shaft extending completely through a pump body (not shown). Said volute 3 is provided in the cylinder housing 8 and comprises, in an intermediate portion thereof, e.g. arranged substantially in alignment with the pump shaft, a supply inlet (not shown) provided with a port for supplying heat-transport fluid to the pump 2 of the engine.

In FIGS. 1 to 3, said cylinder housing 8 also includes an outer pipe 1 of the outlet 4 of the volute 3 of the pump 2 that is attached onto the outer surface 9 of said housing 8. Said outer pipe 1 may be a removable part that is mounted on the outer surface 9. The outer pipe 1 includes a first and second component 5*a*, 5*b* that may be two separate parts that are sealingly assembled/connected together. In an alternative embodiment, said first and second components 5*a*, 5*b* may together form a single part.

Said outer pipe 1 is arranged in the mounting cavity 14 while being mechanically and sealingly connected onto the outer surface 9 of the cylinder housing 8. Said mechanical connection is achieved by means of the engagement of fastening elements, in particular screw elements, with a connection area 10. Said connection area 10 is preferably defined at a peripheral edge of said mounting cavity 14.

The first component 5*a* is capable of guiding, via a second channel 11*b*, the heat-transfer fluid from the outlet 4 of the volute toward the inlet 6 of the inner circuit 7 for circulating the heat-transfer fluid defined in the cylinder housing 8. In other words, the first component 5*a* is capable of contributing to the guiding of the heat-transfer fluid from the outlet 4 of the volute toward the inlet 6 of the inner circuit 7. Said first component 5*a* of this outer pipe 1 forms, together with the second component 5*b*, a first channel 11*a* for circulating the heat-transfer fluid toward at least one device of the cooling circuit. Such a device is another consumer of the heat-transfer fluid of the cooling circuit, which may be e.g. a heat exchanger, such as a unit heater or a motor-oil exchanger better known by the acronym "EMO" and to which the heat generated at the motor-oil housing is discharged. The first channel 11*a* includes an outlet 19 provided with a port. Said outlet 19 is provided in a connection portion 18 of the second component Sb that has a generally cylindrical shape, wherein one end of a connecting pipe, also referred to as a hose, may be attached onto said portion 18 in order to connect the outer pipe 1 to the device of the cooling circuit.

In one alternative embodiment of the outer pipe 1, the inner circuit 7 may include an element (not shown) for regulating the circulation of the pressurized heat-transfer fluid. Said regulator element arranged downstream from the inlet 6 enables the management of the flow rate at the cooling chambers of the inner circuit 7. Said regulating element can be a solenoid valve, a pilot valve or a thermostatic valve. In this configuration, the outer pipe 1 is thus capable of variably circulating the heat-transfer fluid in order to cool the cylinder housing 8. Indeed, when the regulator element is in a position closing the inner circuit 7, the flow rate of the fluid passing through the second channel 11*b* described herein and which continues to supply the outlet 19 so as not to interrupt the supply of fluid to the other consumers.

The first component 5*a* of said outer pipe 1 is capable of guiding the heat-transfer fluid from the outlet 4 of the volute 3 of the pump 2 toward the inlet 6 of the inner circuit 7 comprising the inner supply pipe 15 consisting of at least one cooling chamber. More specifically, the first component 5*a* forms, together with the outer surface 9 of the housing 8 and in particular with the mounting cavity 14, the second channel 11*b* for circulating the heat-transfer fluid toward said inlet 6 of the inner circuit 7.

The first component 5*a* of said outer pipe 1 includes an area 12 through which the heat-transfer fluid passes from the second channel 11*b* to the first channel 11*a*. Said passage area 12 is preferably provided on a portion of said first component 5*a* that may be defined equidistantly from the ends 24*a*, 24*b* of said component 5*a* that are shown in FIG. 2. Said passage area 12 is created by openings 13 which are visible in a cross-section of the passage area 12 in FIG. 3 that essentially has the shape of an inverted "U". The passage area 12 includes side walls 23 that each include an opening 13. Said openings 13 contribute to the passage of the heat-transfer fluid from the second channel 11*b* to the first channel 11*a*.

Thus, in reference to FIGS. 2 and 3, in said cylinder housing 8, when the pump 2 circulates the heat-transfer fluid in the cooling circuit, the fluid is then discharged from the pump 2 via the outlet 4 of the volute 3 to circulate under pressure in the second channel 11*b* in the direction of the arrows referenced 20. By circulating in said second channel 11*b*, said fluid is thereby directed toward the inner circuit 7 defined in the cylinder housing 8 via the inlet 6, as well as toward at least one device of the cooling circuit while passing through the passage area 12, in particular through the openings 13 defined in said area 12, in the direction of the arrows referenced 21. In this configuration, by passing through the passage area 12, the fluid thereby passes from the second channel 11*b* to the first channel 11*a* until it is directed toward the device via the outlet referenced 19 and the pipe connecting the connecting portion 18 of the second component 5*b* to said device in the direction of the arrow 22.

Such an outer pipe 1 thus makes it possible to channel the pressurized heat-transfer fluid continuously from the volute 3 of the pump 2 in order to minimize head loss. Furthermore, such an outer pipe 1 is easily mechanically connected onto the outer surface 9 of the cylinder housing 8 and is further compatible with cylinder housings 8 manufactured according to various foundry processes, and in particular according to a high-pressure casting foundry process.

The invention claimed is:

1. An outer pipe of an outlet of a volute of a heat-transfer pump, arranged in a recess defined in a heat engine of a vehicle, the outer pipe being provided on an outer surface of a cylinder housing of the engine, and comprising:

a first component configured to guide the heat-transfer fluid from said outlet toward an inlet of an inner circuit for circulating the heat-transfer fluid defined in the cylinder housing; and a second component forming, together with the first component, a first channel for circulating the heat-transfer fluid toward at least one device of a cooling circuit, wherein the first component forms, together with the outer surface of the housing, a second channel for circulating the heat-transfer fluid toward said inlet of the inner circuit for circulating the heat-transfer fluid defined in the cylinder housing.

2. The outer pipe according to claim 1, wherein:

the first component includes an area through which the heat-transfer fluid passes from the second channel to the first channel, and/or an area through which the heat-transfer fluid passes from the second channel to the first channel includes at least one opening.

3. The outer pipe according to claim 1, wherein the first component and the second component:

are two separate parts that are sealing connected together, and/or together form a single part.

4. The outer pipe according to claim 1, wherein the outer pipe is a removable part and/or an attachment.

5. A cylinder housing of an engine of a vehicle including a cooling circuit provided with a heat-transfer pump arranged in said cylinder housing and an outer pipe according to claim 1.

6. The cylinder housing according to claim 5, wherein:

the outer surface of said housing includes a cavity for mounting said outer pipe, and/or the cylinder housing is manufactured according to a high-pressure casting foundry process, and/or the cylinder housing is made from aluminum or an aluminum alloy, and/or the mounting cavity forms a cavity provided with two ports corresponding to the outlet of the volute of the heat-transfer pump, and to the inlet of the inner circuit for circulating the heat-transfer fluid defined in the cylinder housing, respectively, and/or the mounting cavity includes a connection area at which the outer pipe is mechanically and sealingly connected to the outer surface of the cylinder housing.

7. An engine including a cylinder housing according to claim 5.

8. A vehicle including an engine according to claim 7.

* * * * *